US011952226B2

(12) United States Patent
Haapanen

(10) Patent No.: US 11,952,226 B2
(45) Date of Patent: Apr. 9, 2024

(54) ASSEMBLY FOR HANDLING REEL SPOOLS AND A REEL-UP UNWINDING ARRANGEMENT FOR A FIBER WEB MACHINE

(71) Applicant: Valmet Technologies Oy, Espoo (FI)

(72) Inventor: Jaakko Haapanen, Järvenpää (FI)

(73) Assignee: Valmet Technologies Oy, Espoo (FI)

( * ) Notice: Subject to any disclaimer, the term of this patent is extended or adjusted under 35 U.S.C. 154(b) by 0 days.

(21) Appl. No.: 17/867,441

(22) Filed: Jul. 18, 2022

(65) Prior Publication Data

US 2023/0030512 A1 Feb. 2, 2023

(30) Foreign Application Priority Data

Jul. 30, 2021 (FI) ..... 20215826

(51) Int. Cl.
*B65H 19/12* (2006.01)
*B65H 19/22* (2006.01)

(52) U.S. Cl.
CPC ..... *B65H 19/126* (2013.01); *B65H 19/2207* (2013.01); *B65H 2301/41734* (2013.01)

(58) Field of Classification Search
None
See application file for complete search history.

(56) References Cited

U.S. PATENT DOCUMENTS 1,664,176 A * 3/1928 Johancen et al. .. B65H 19/1894 242/555.3
4,239,165 A * 12/1980 Weiss ..... B65H 19/12 242/559.4
4,720,231 A 1/1988 Pienta
5,603,270 A * 2/1997 White ..... D06H 5/00 112/475.08
6,386,477 B1 * 5/2002 Kaufmann ..... B65H 19/1821 242/555.3
6,402,083 B1 6/2002 Horn et al.
2004/0118964 A1 * 6/2004 Long ..... B65H 19/126 242/555.3
2009/0220323 A1 * 9/2009 Pienta ..... B65H 19/126 414/222.01
2012/0048986 A1 * 3/2012 Enwald ..... B65H 19/126 242/598.5
2020/0370218 A1 11/2020 Myers et al.
2020/0370219 A1 * 11/2020 Myers ..... B65H 19/126
(Continued)

FOREIGN PATENT DOCUMENTS

CN 111674987 * 9/2020
CN 112623827 * 9/2021
JP H0395003 A 4/1991
(Continued)

*Primary Examiner* — William A. Rivera
(74) *Attorney, Agent, or Firm* — James Earl Lowe, Jr.

(57) ABSTRACT

An assembly for handling reel spools, comprising linear support rails, having a first end and a second end, arranged parallel to each other, and a reel spool cart arranged on the support rails, the support rails being arranged at a first distance from each other, the first distance being greater than axial length of the reel spool, and the cart being provided with a hoisting device configured to hoist the reel spool vertically from beneath of at least one of the support rails to at least partly above at least one of the support rails.

15 Claims, 8 Drawing Sheets

(56) References Cited

U.S. PATENT DOCUMENTS

2021/0205869 A1* 7/2021 Mattäß ..... B65H 19/126

FOREIGN PATENT DOCUMENTS

| | | | | |
|---|---|---|---|---|
| JP | H06126332 | A | | 5/1994 |
| JP | 2016003134 | A | | 1/2016 |
| JP | 2021113101 | | * | 8/2021 |
| WO | WO 2009092861 | | * | 7/2009 |
| WO | WO 2010000944 | | * | 1/2010 |
| WO | 2010097515 | A1 | | 9/2010 |

* cited by examiner

ASSEMBLY FOR HANDLING REEL SPOOLS AND A REEL-UP UNWINDING ARRANGEMENT FOR A FIBER WEB MACHINE

TECHNICAL FIELD

The present invention relates to an assembly for handling reel spools and a reel-up—unwinding arrangement for a fiber web machine.

BACKGROUND ART

The reel-ups of web-like materials are used for reeling a material passed as a continuous web into a tight reel, so that it can be transferred to further processing. For example in reel-ups of a paper web, a continuous paper web passed from a paper machine, coating machine or a corresponding paper processing apparatus is wound around a reel spool to form a reel. The web is brought onto the reel via a reeling cylinder which is arranged rotatable and against which the reel is pressed by means of a loading device provided in connection with the reel spool. Thus, the web enters the reel so that it is pressed in between the preceding layers of the reel and the mantle surface of the reeling cylinder.

In paper-manufacturing lines, the manufacture of fiber web, such as paper or board takes place as a continuous process. A fiber web completing in the paper machine is reeled by a reel-up around a reeling shaft, i.e. a reel spool, into a parent roll, the diameter of which can be more than 5 meters and the weight more than 160 tons. The purpose of reeling is to modify the fiber web manufactured as continuous sheet to a more easily processable form. On the reel-up located in the main machine line, the continuous process of the paper machine breaks for the first time and shifts into periodic operation.

The web of the parent roll produced in paper manufacture is full-width and can be more than 100 km long so it must be slitted into partial webs with suitable width and length for the customers of the paper mill and wound around cores into so-called customer rolls before delivering them from the paper mill. This slitting and winding up of the web take place as known in an appropriate separate machine, i.e., a slitter-winder. On the slitter-winder, the parent roll is unwound, the wide web is slit on the slitting section into several narrower partial webs which are wound up on the winding section around winding cores, such as spools, into customer rolls. When the customer rolls are completed, the slitter-winder is stopped and the wound rolls, i.e., the so-called set, is removed from the machine. Then, the process is continued with the winding of a new set. These steps of so-called set change are repeated in sequences periodically until paper runs out of the parent roll, whereby a parent roll change is performed and the operation starts again as the unwinding of a new parent roll. The empty reel spool is then returned back to the reel-up. The reel-up must be provided with a new or empty reeling shaft before the previous one is full, i.e. the parent roll is ready for roll change. Usually, a number of empty parent rolls is stored at a so-called reel spool storage. There is a circulation of reel spools between the reel-up and an unwinding station of the slitter-winder where full rolls with reel spools are transferred to the unwinding station and empty reel spools are returned back to the reel-up. Corresponding reel spool circulation is also between, for example a web producing machine and an off-line coater or other web finishing machine.

An example of a reel-up according to the prior art is shown in document U.S. Pat. No. 5,943,787A. Usually the empty reel spools are returned back to the reel-up by making use of an overhead bridge crane of the machine hall. Since there is practically a need for continuous returning process of reel spools, returning the reel spools with the bridge crane reserves the crane and its operator from other uses, decreases usability of the overhead crane.

It is also known to return the empty reel spools automatically by a winding shaft handling apparatus, as is disclosed for example in the document WO2010125232 A2. In the publication a reference is made to returning rails as well as a cart based moving of reel spools and machine rolls.

An object of the invention is to provide an assembly for handling reel spools with which the performance is considerably improved compared to the prior art solutions.

DISCLOSURE OF THE INVENTION

Objects of the invention can be met substantially as is disclosed in the independent claims and in the other claims describing more details of different embodiments of the invention.

An assembly for handling reel spools comprises linear support rails, having a first end and a second end, arranged parallel to each other, a reel spool cart, comprising a transverse bridge, arranged on the support rails, the support rails being arranged at a first distance from each other, the first distance being greater than axial length of the reel spool, the cart being provided with a hoisting device wherein the hoisting device is configured to hoist the highest point of the reel spool vertically from beneath of at least one of the support rails to at least partly above the at least one of the support rails, and the reel spool cart is provided with lay-down support for the reel spool at its both ends wherein the lay-down support is provided with a drive by means of which the lay-down support can be moved under a bearing housing of the reel spool, after the reel spool has been lifted to a vertical position above the lay-down support.

This way transferring reel spools can be accomplished without use of a bridge crane of the machine hall and operating the parent rolls and empty reel spools becomes more fluent.

In practise the assembly for handling reel spools is dimensioned for each practical application separately so that at least the distance between the support rails is greater than the length of the reels spools in use or to be used.

According to an embodiment of the invention the hoisting device is configured to hoist the reel spool vertically at least partly above a bridge of the reel spool cart. This way the need of vertical space for returning or moving reel spools is considerably only moderate and more space is left free for other procedures, such as operating the machine.

According to an embodiment of the invention the cart is provided with locking means configured to prevent movement of the hoisted reel spool in relation to the cart, at least in the longitudinal direction of the support rails (12). This way the transfer of the reel spool is safe and accurate and possible swaying of the reel spool is prevented.

According to an embodiment of the invention the cart is provided with locking means configured to prevent rotation of the reel spool. This way unintended unwinding of reel bottom is prevented. The locking means is configured to releasably lock the reel spool to the cart.

According to an embodiment of the invention the hoisting device is configured to lay the reel spool down on the support. This way it is possible for example unwind of reel bottom making use of the assembly.

According to an embodiment of the invention the cart is provided with a lay-down support for the reel spool at both ends of the cart, configured to support the reel spool from its bearing housing at its both ends.

According to an embodiment of the invention the cart is provided with a rotator configured to rotate the reel spool. This way it is possible for example unwind of reel bottom making use of the assembly.

According to an embodiment of the invention the cart is provided with lay-down support for the reel spool at its both ends and the cart is provided with a rotator configured to rotate the reel spool. This way it is possible for example unwind of reel bottom in controlled manner making use of the assembly.

According to an embodiment of the invention the reel spool rotator is configured transmit force to a clutch part at an end of the reel spool.

According to an embodiment of the invention the lay-down supports are arranged movable in the longitudinal direction of the cart so as to position the lay-down supports at a first position under the bearing housings of the reel spool and at a second position outside the length of the reel spool, when lifted by the hoisting device. This facilitates lifting of the reel spool in the cart above the bridges and also support the reel spools in the cart safely.

According to an embodiment of the invention the lay-down supports are configured to move the lay-down supports to a first position under the bearing housings of the reel spool by rotational movement, and to a second position outside the length of the reel spool, also be rotational movement. This facilitates lifting of the reel spool in the cart above the bridges and also support the reel spools in the cart safely. Movement of the lay-down supports may also comprise combination of rotational and translational movements.

According to an embodiment of the invention the cart comprises two bridges extending between the support rails and the hoisting device is configured to hoist the reel spool between the bridges.

According to an embodiment of the invention the assembly comprises a dedicated support structure under both of the support rails.

According to an embodiment of the invention the hoisting device comprises hook hoist at both ends of the cart configured for hoisting the reel spool from its shaft.

A reel-up—unwinding arrangement for a fiber web machine, comprising a reel-up station at a first end of the arrangement, configured to produce parent rolls from a running web on a reel spool supported from bearing housing at its ends, and an unwinding station at a second end of the arrangement, configured to controllably unwind web from the parent rolls produced in the reel-up station, which is provided with an assembly for handling reel spools comprising linear support rails, having a first end and a second end, arranged parallel to each other, a reel spool cart arranged on the support rails, the support rails being arranged at a first distance from each other, the first distance being greater than axial length of the reel spool, the cart being provided with a hoisting device configured to hoist the reel spool vertically from beneath of at least one of the support rails to at least partly above the at least one of the support rails, which assembly for handling reel spools is configured to operate between the reel-up station and the un-winding station.

According to an embodiment of the invention the assembly for handling reel spools in the reel-up—unwinding arrangement for a fiber web machine is configured to return empty reel spools from the unwinding station to the reel-up station.

According to an embodiment of the invention the arrangement comprises parallel transfer rails between the reel-up station and the unwind station for transporting the parent rolls from the reel-up station to the unwind station, the transfer rails arranged at a second distance from each other, the second distance being less than the first distance between the support rails.

According to an embodiment of the invention the support rails are arranged vertically higher than the transfer rails wherein the vertical distance between support planes of the transfer rail and the support rail is configured such that a gap of less than 200 mm is formed between a full reel spool supported by the transfer rails and an empty reel spool supported by the cart on the support rails.

According to an embodiment of the invention the vertical distance between the support planes of the transfer rail and the support rail is configured such that a gap of 20-200 mm is formed between a full reel spool supported by the transfer rails and an empty reel spool supported by the cart on the support rails.

According to an embodiment of the invention the support rails are arranged vertically higher than the transfer rails wherein the vertical distance between the support planes of the transfer rail and the support rail is 1000-3000 mm.

According to an embodiment of the invention the locking means comprise a mechanical stop against which at least one of the reel spool and a hook of the hoisting device is moved for locking the reel spool in relation to the cart.

The exemplary embodiments of the invention presented in this patent application are not to be interpreted to pose limitations to the applicability of the appended claims. The verb "to comprise" is used in this patent application as an open limitation that does not exclude the existence of also unrecited features. The features recited in dependent claims are mutually freely combinable unless otherwise explicitly stated. The novel features which are considered as characteristic of the invention are set forth in particular in the appended claims.

BRIEF DESCRIPTION OF DRAWINGS

In the following, the invention will be described with reference to the accompanying exemplary, schematic drawings, in which.

DETAILED DESCRIPTION OF DRAWINGS

Figure 1:
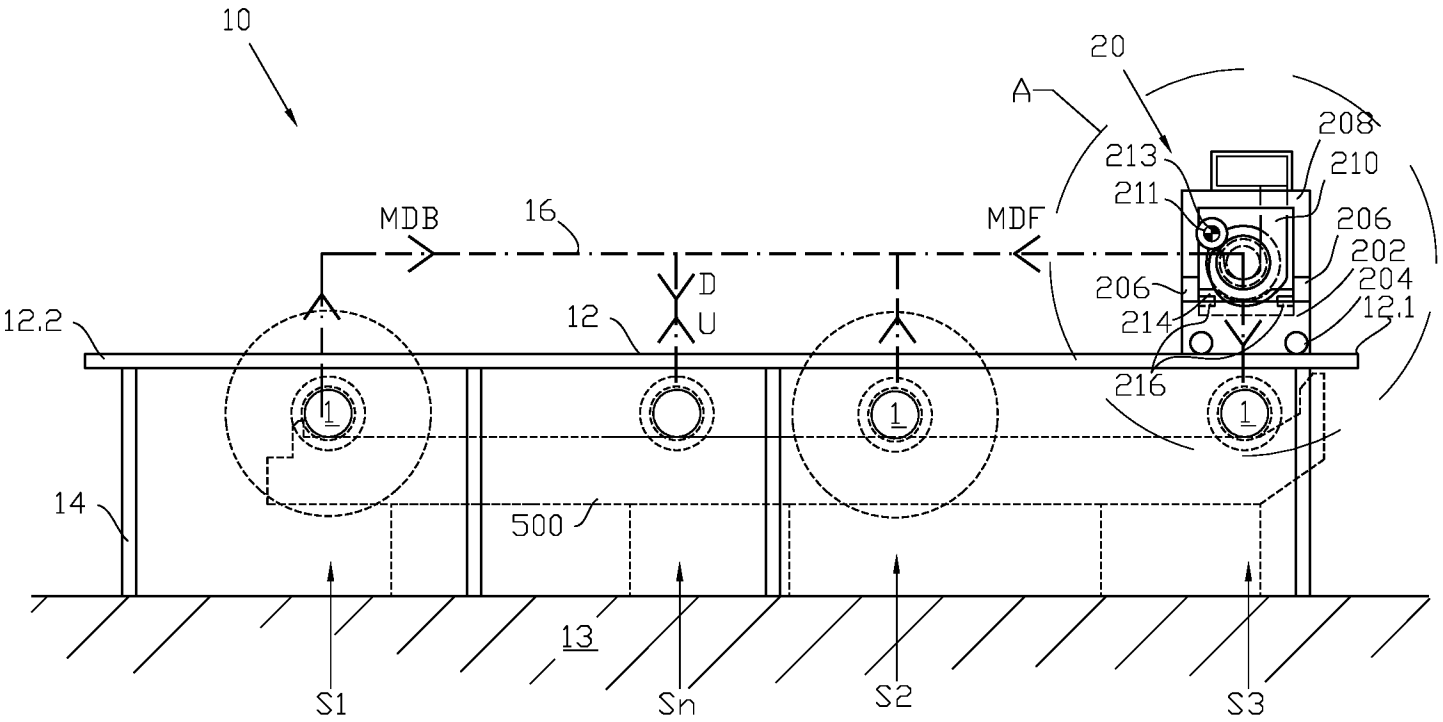
FIG. 1 illustrates an assembly for handling reel spools according to an embodiment of the invention.
Figure 2:
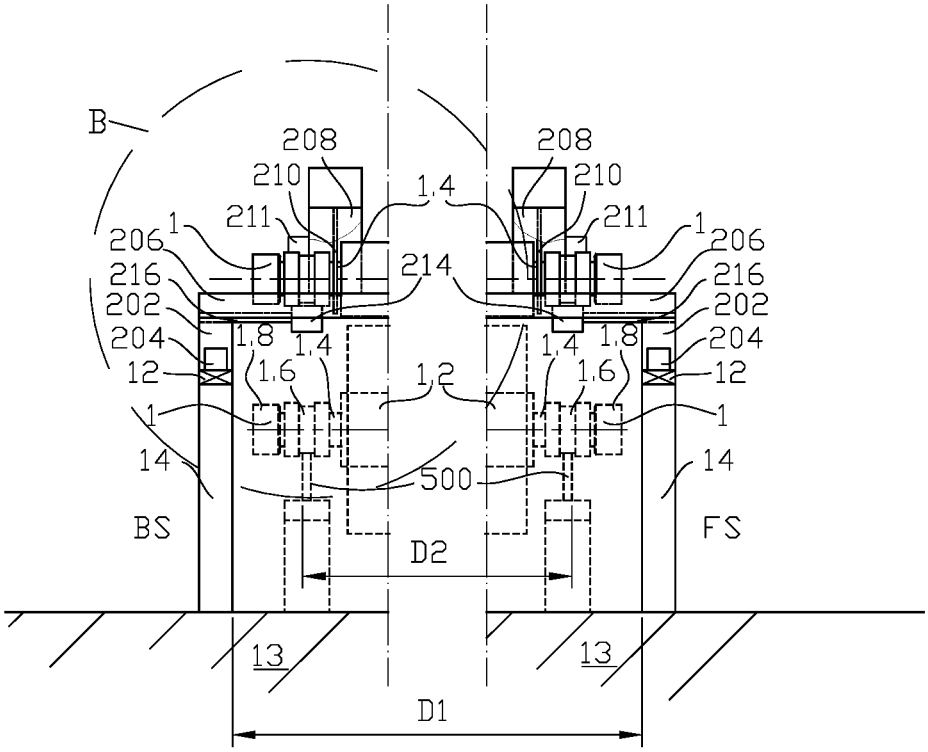
FIG. 2 illustrates an end view of the assembly for handling reel spools in the FIG. 1.

FIGS. 1 and 2 depict schematically an assembly 10 for handling reel spools 1. FIG. 1 shows a side view of the assembly and FIG. 2 shows the assembly seen from its end. Following description refers to the FIGS. 1 to 4. As is well known in the art of manufacturing paper and/or board or a like, which is referred to as a fiber web, reel spools are used for continuously reeling the fiber web and temporarily store the fiber web before the web is unwound from the reel spool. The assembly 10 for handling reel spools 1 comprises linear, horizontally arranged support rails 12, more precisely two parallel rails 12. The rails 12 have a first end 12.1 and a second end 12.2 which define the operational area of the assembly 10 in a so called machine direction. More particularly the assembly is configured to move reel spools in a direction transverse to the longitudinal direction of the reel spool 1 between predetermined roll handing stations S1 . . . Sn arranged at difference locations in machine direction, such as unwinding station S1 and reel-up station S2 or reel spool storage S3, within the operational area of the assembly. The roll handling stations S1 . . . Sn are arranged between the rails 12.1,12.2, as well as between the first end 12.1 and a second end 12.2 of the rails. The rails 12 are supported by e.g. vertically extending columns 14 from suitable foundation 13. The foundation may be for example a floor of the building or a concrete pillar, or a like. The support structure formed by the columns 14 is advantageously a support structure dedicated to the assembly. FIG. 1 shows a track line 16 with respective arrows indicating the possible directions of movement of the reel spools 1: machine direction forwards (MDF); machine direction backwards (MDB); upwards (U); downwards (D). This provides a versatile manner of handling reel spools, either as an empty reel spool or as a reel spool having a reel bottom still wound on it. Advantageously the assembly is dimensioned for transporting only the reels spools, with an option of having minor amount of unwound web on it. This way the physical size is as small as possible, and it can be fitted more easily in connection with and between (in machine direction) a reel-up and unwinder.

The assembly comprises a reel spool cart 20 supported by the rails 12.1, 12.2 at the ends of the cart 20, as can be seen in the FIG. 2. Only one cart 20 is needed for operation of the assembly. A reel spool has cylindrical body 1.2 which has shafts 1.4 at its ends. The shafts are provided with bearing housings 1.6 which coupled to the shaft with suitable bearings. The shafts extend axially through the bearing housings 1.6 and are provided with a clutch part 1.8 at the end of the shaft 1.4 for rotating the reel spool when resting on the bearing housing. As can be seen in the FIG. 2 the support rails 12.1,12.2 are arranged at a distance D1 from each other, which may be referred to as a first distance. The first distance is greater than axial length of the reel spool 1 such that the reel spool can be lifted horizontally between the rails up to above the rails 12.1,12.2 and down below the rails.

The reel spool cart 20 comprises a carrier part 202 at its both ends, which couples the cart 20 to the rails 12. The carrier part 202 is provided with means 204 for moving the cart so as to move the cart 20 along the rails 12. The means for providing moving traction may comprise suitable wheels 204 and suitable motor or drive for controllably move the cart 20 back and forth in machine direction. The cart 20 is further provided with a transverse bridge 206, preferably two parallel bridges 206 at substantially same horizontal level, which bridges extend between the carrier parts 202 at opposite sides of the assembly. Supported by the bridges 206, there is a hoisting device 208 arranged respectively to both ends of the bridges 206. It is conceivable within the scope of the invention to design the cart by using only one bridge, in which case hoisting operation is performed on one side of the single bridge. The hoisting device 208 is immovably attached to the cart so that distance between the hoisting devices is suitable for the reel spools in use or to be used. The hoisting device 208 is provided with a hook hoist 210 which is configured to grab the reel spool 1 from its shaft 1.4 next to the bearing housing 1.6. This way the reel spool cannot rotate while being lifted by the hooks. The hoisting device 208 is configured to hoist the reel spool 1 vertically from beneath the support rails 12.1, 12.2 to at least partly above the support rails. Alternatively, if more vertical space is required, the hoisting device 208 is configured to hoist the reel spool 1 vertically to at least partly above the bridges of the cart. Advantageously the hook is configured such that its position remains the same regardless of being with or without load, that is the reel spool.

Figure 3:
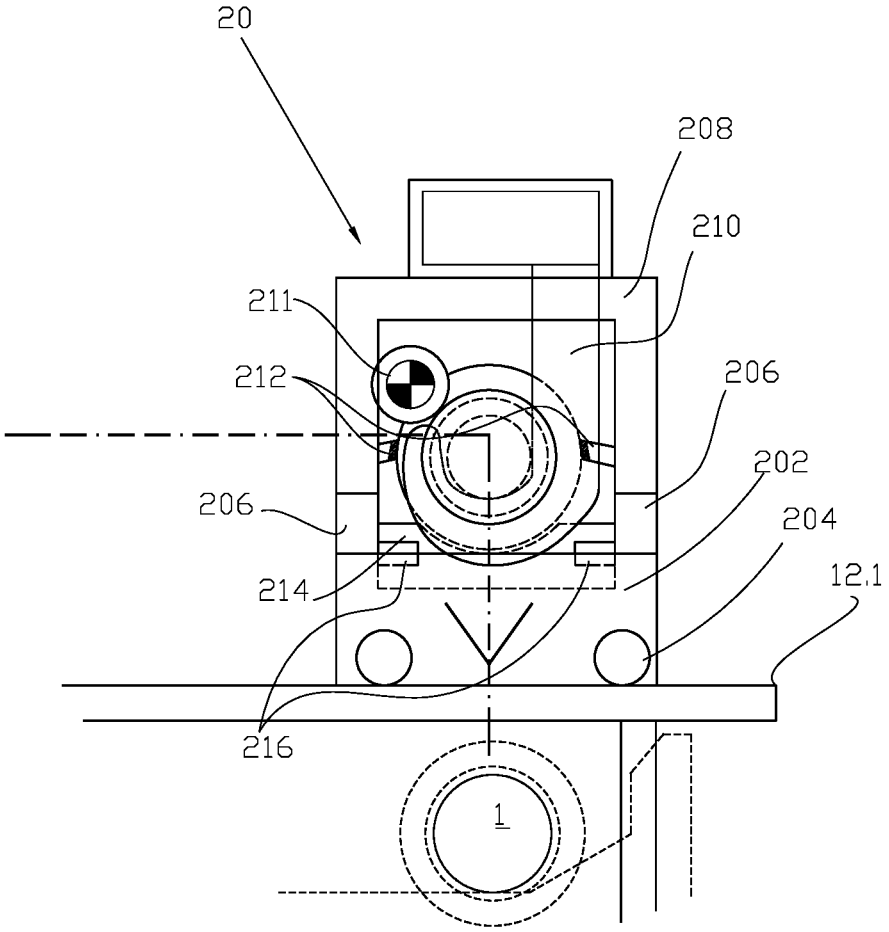
FIG. 3 illustrates an enlargement of the detail A in the FIG. 1.
Figure 4:
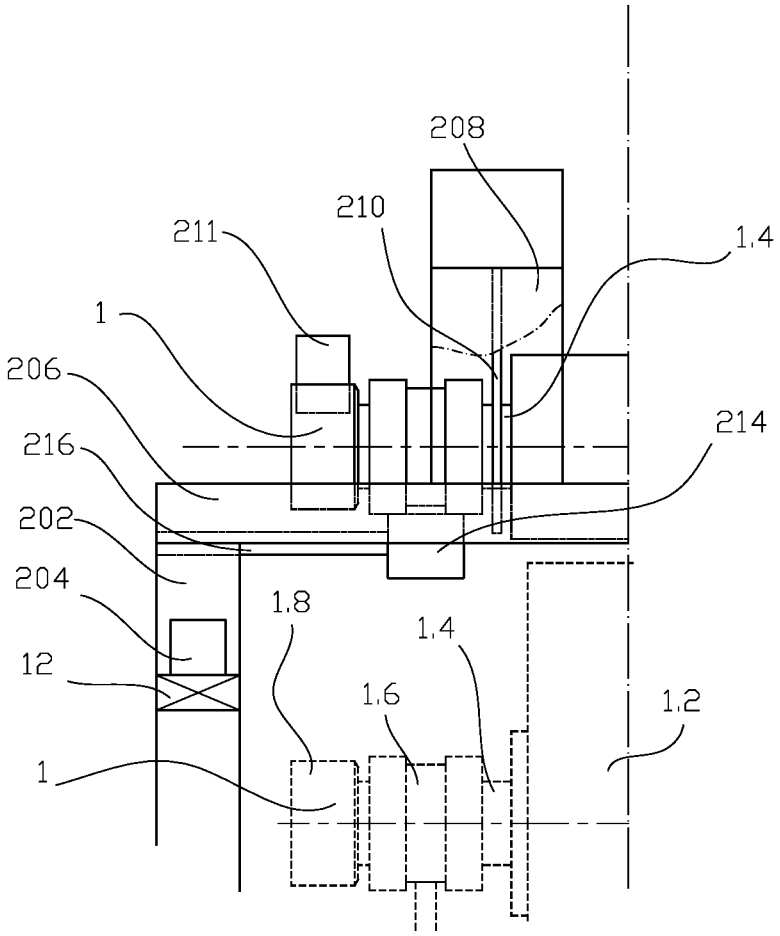
FIG. 4 illustrates an enlargement of the detail B in the FIG. 2.

There is a locking means 212 arranged to assembly, which locking means 212 is shown only in the FIG. 3 for clarity reasons. More particularly the locking means is arranged to the hoist device 208 of the cart, by means of which movement of the hoisted reel spool 1 in relation to the cart 20 at least in the longitudinal direction of the support rails 12 can be prevented. This prevents possible swaying of the reel spool caused by acceleration of the cart during start and stop of the transfer movement of the cart. The locking means 212 comprise a mechanical stop or stops, as is shown in the FIG. 3, against which the reel spool 1 and/or the hook 210 of the hoisting device 208 is moved from beneath the locking means when lifted by the hooks, for locking the reel spool 1. Alternatively, the locking means may be provided with an actuator or a like, by means of which the locking means may be moved against the reel spool when it is at suitable position in the cart.

The assembly may comprise, as is shown in the figures, a reel spool rotator 211. By means of the rotator 211 the rotation of the reel spool 1 can be controlled, that is either prevent unintentional rotation of the reel spool or controllably make the reel spool to rotate. The rotator 211 is arranged in co-operation with the shaft 1.4, or with the clutch part 1.8 at the end of the shaft 1.4. The rotator 211 may comprise a rotatable wheel provided with a drive 213, which wheel is arranged to be engaged with or disengaged from the reel spool 1. The rotator 211 may also be used as the locking means in which case the cart is not necessarily provided with separate locking means, as described above. In other words, the assembly may be provided with a combined locking means and rotator.

The cart 20 is provided with a lay-down support 214 for the reel spool 1. The lay-down support is arranged in connection with the bridges 206 of the cart 20, movably in the longitudinal direction of the bridges 206 in guided manner. The lay-down support 214 is provided with a drive 216, advantageously a linear drive, by means of which the lay-down support 214 can be moved under the bearing housing 1.6 of the reel spool 1, after the reel spool has been lifted to a vertical position above the lay-down support 214. In other words, the lay-down supports 214 are arranged movably in the longitudinal direction of the cart 20 so as to position the lay-down supports at a first position under the bearing housings 1.6 of the reel spool 1 and at a second position outside the length of the reel spool 1 when lifted by the hoisting device 208. The drive 216 can be for example a hydraulic cylinder or a worm screw. The lay-down support is attached to the bridges by suitable guide or guides so as to be linearly movable by the drive 216. A reel bottom can be unwound from the reel spool 1 while the reel spool supported by the cart 20 at its bearing house. Unwinding of the reel bottom is done by making use of the rotator 211.

FIGS. 1 and 2 shows a pair of transfer rail 500 under the support rails 12.1,12.2. The support rails 12.1,12.2 are arranged at a distance D1 from each other, which may be referred to as a first distance. The transfer rails are arranged parallel to each other having a distance D2, which may be referred to as a second distance. The second distance D2 being less than the first distance D1.

When moving the reel spool 1 by the assembly, following steps are practised:

1. The cart is driven at a location above the reel spool,
2. Hooks of the hoisting devices lowered and the hooks and/or the cart is controlled such that the hooks engage to the reel spool from a neck of its shaft adjacent to the body of the reel spool, at both ends of the reel spool,
3. The reel spool is lifted by the hoisting device at least partly above at least one of the support rails of the assembly,
4. The reel spool is locked to the cart preventing its swaying movement, as optional, but preferable measure
5. The cart is moved to new desired position of the reel spool
6. The reel spool is unlocked, in case it was locked according to the step 4
7. The reel spool is lowered to the new desired location by lowering the hooks of the hoisting devices and controlling the hooks and/or the cart such that the hooks disengage the reel spool Now turning to the FIG. 5, which discloses a reel-up—unwinding arrangement 100 for a fiber web machine, one can see that there are several reel spool handling stations, such as a reel-up station S2 within the operational area of the assembly for handling reel spools 10. The reel-up station S2 is configured to produce so called machine rolls from continuously running web W on a reel spool 1. There is also an unwinding station S1 which is configured to controllably unwind web from the parent rolls produced in the reel-up station. Unwinding of the web may relate to, for example a web finishing section, such as an off-line coating machine. The reel-up and the unwinding stations are within the operational area of the arrangement 10, which is configured to operate between the reel-up station and the unwinding station. Thus, the assembly 10 for handing the reel spools 1 is arranged in connection with the reel-up—unwinding arrangement 100 and the assembly is configured i.a. to return empty reels spools from the unwinding station to the reel-up station. The assembly for handling the reel spools 1 in the reel-up—unwinding arrangement 100 can be realized according any one of the embodiments of the assembly 10 described in this application.

In the reel-up—unwinding arrangement 100 according to the invention the reel-up station S2 and the unwinding station S1 are connected with each other by a pair of transfer rails 500 configured to support and transfer full machine rolls from the reel-up station S2 to the unwinding station S1. As is shown in the FIG. 2, the transfer rails 500 are arranged parallel to each other having a distance D2. The transfer rails 500 are vertically under the support rails 12.1,12.2 of the assembly 10 for handling reel spools. Even if FIG. 2 does not show the reel-up, nor unwinding stations, the transfer rails are similar and also in the reel-up—unwinding arrangement 100 the support rails 12.1,12.2 are arranged at a distance D1 from each other, which may be referred to as a first distance. The transfer rails 500 are arranged parallel to each other having a distance D2, which may be referred to as a second distance. The second distance D2 being less than the first distance D1.

The support rails 12 are arranged vertically higher than the transfer rails 500 wherein the vertical distance between the support planes, on which plane the reel spool is supported, of the transfer rail 500 and the support rail 12 is configured such that a gap G of less than 200 mm is formed between surface of a full reel spool—a full parent roll—supported by the transfer rails 500 and an empty reel spool 1 supported by the cart 20 on the support rails 12.

The vertical distance between the support planes of the transfer rail 500 and the support rail 12 is configured such that a gap of 20-200 mm is formed between a full reel spool 1 supported by the transfer rails and an empty reel spool 1 supported by the cart 20 on the support rails. In most of the practical application the vertical distance between the support planes of the transfer rail and the support rail is 1000-3000 mm.

Figure 5:
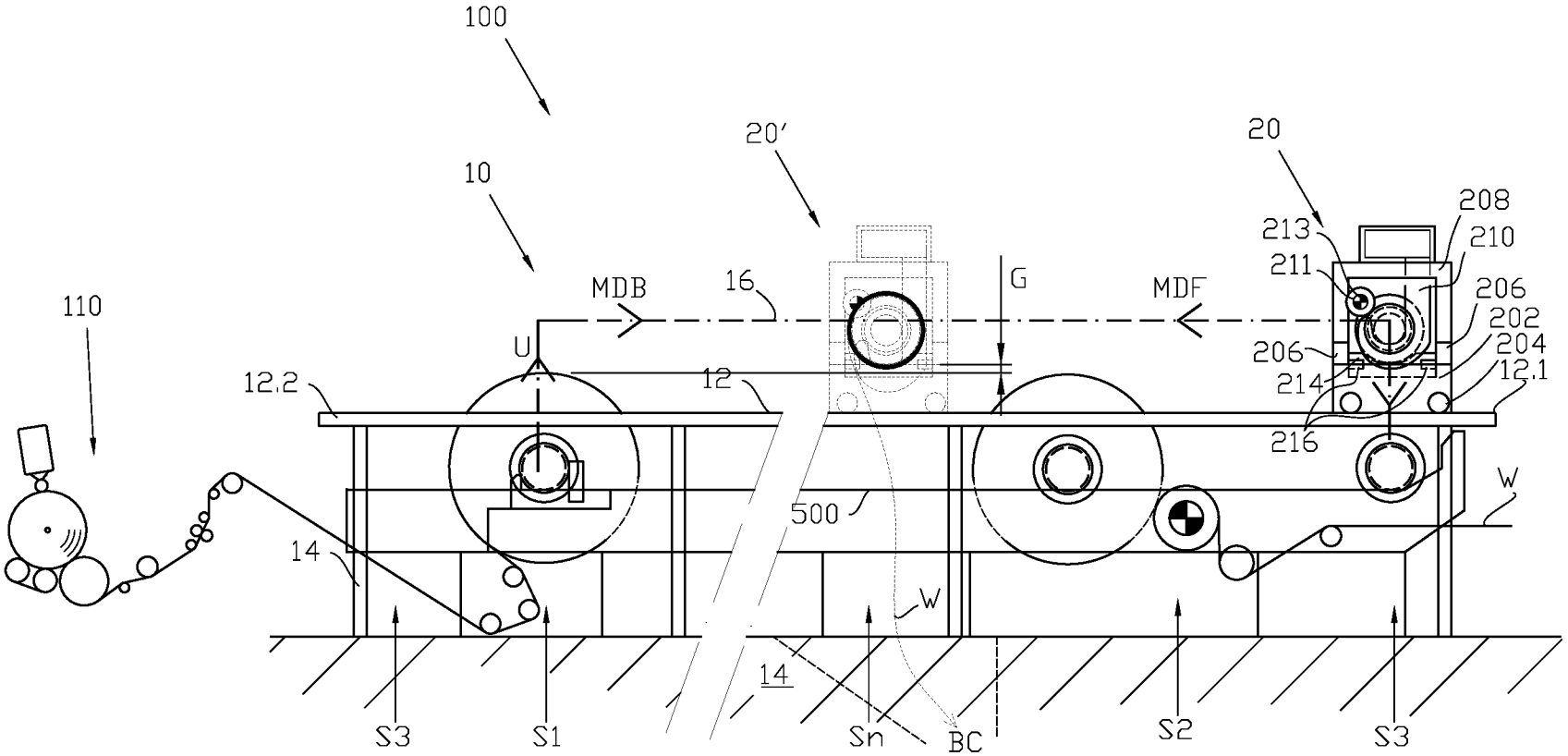
FIG. 5 illustrates a reel-up—unwinding arrangement for fiber web according to an embodiment of the invention.

As it becomes clear from the FIG. 5 the transfer rails 500 extend backwards in the machine direction MDB past the reel-up station S2, the section forming a reel spool storage station S3. The first ends 12.1 of the rails 12 in the assembly 10, correspondingly, are arranged before the reel-up station S2, in the machine direction, to extend into the reel spool storage station S3. This way empty reel spools 1 may be return from the unwind-station S1 to the reel spool storage station S3.

Correspondingly, the transfer rails 500 extend forwards in the machine direction MDF past the unwinding station S1 forming a reel spool storage station S3. The second ends 12.2 of the rails 12 in the assembly 10, correspondingly, are arranged to extend after the unwinding station S1, in the machine direction. The station Sn may refer to a station for unwinding reel bottom on the reel spool after the unwinding process to a pulper or a broke conveyor BC, for example. The station $S_n$ for unwinding the reel bottom may be selected substantially freely and there for emptying the reel spool can be done even at a location adjacent to a full parent roll on the transfer rails 500, such as between two parent rolls. Unwinding a reel bottom adjacent to a parent roll is depicted in the FIG. 5 where the cart 20' is position beside the reel-up station S2. The reel spool is lowered to the lay-down support and web is running to the pulper or a broke conveyor BC of the reel-up station S2.

Figure 8:
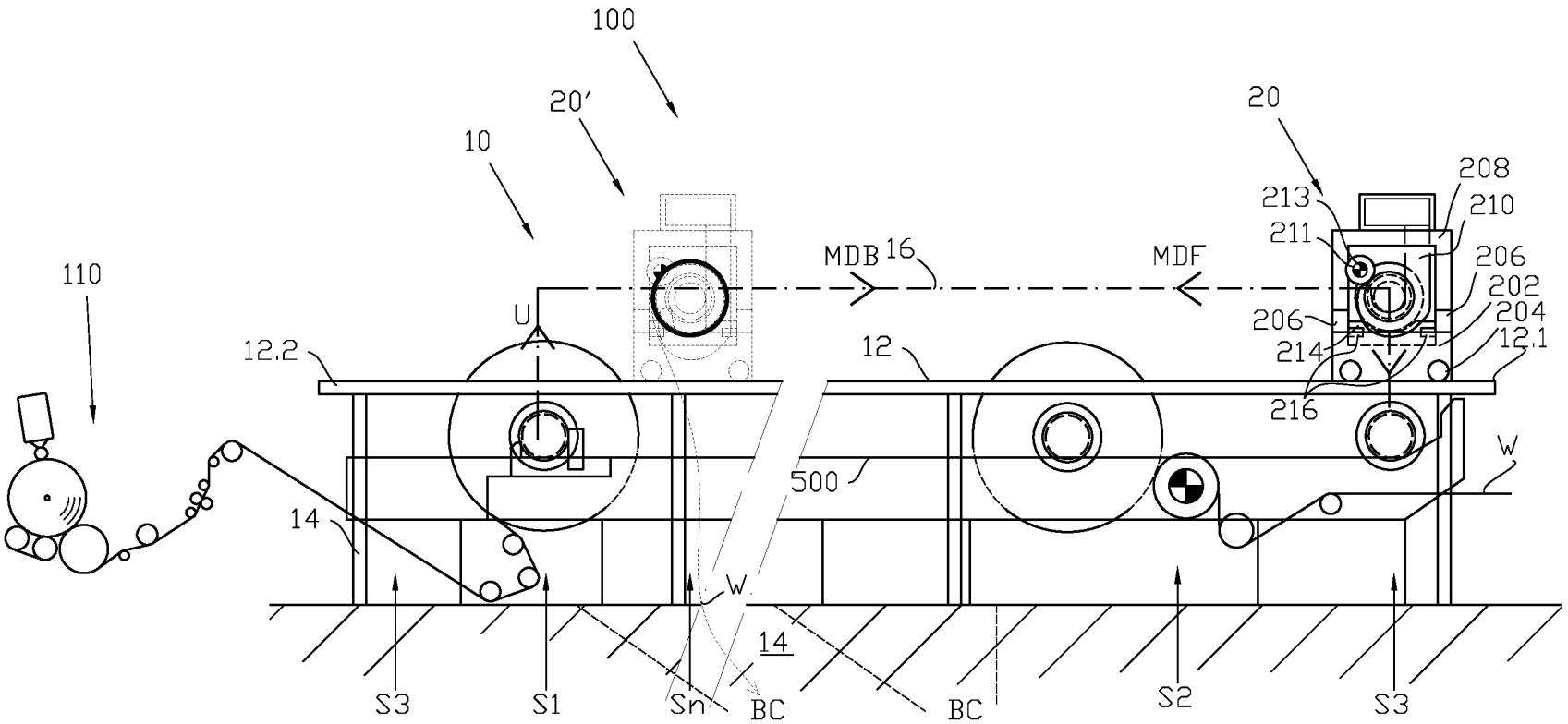

Generally, a method of unwinding the reel bottom in the assembly 10 for handling reel spools comprises the following steps:

1. The cart is driven at a location above the reel spool containing the bottom of the roll,
2. Hooks of the hoisting devices lowered and the hooks and/or the cart is controlled such that the hooks engage to the reel spool from a neck of its shaft beside body of the reel spool,
3. The reel spool is lifted by hoisting device at least partly above at least one of the support rails of the assembly,
4. Cart is driven to a suitable position in machine direction above a pulper or a broke conveyor 5. The reel spool is lowered on the lay-down support so as to be rotatable while supported by the cart, and hooks a disengaged from the reel spool
6. The reel spool is rotated by operating the rotator of the assembly to rotate the reel spool thus unwinding the reel bottom from the reel spool In the FIG. 8 there is disclosed a reel-up—unwinding arrangement 100 for a fiber web machine of the FIG. 5 which discloses another station Sn for unwinding reel bottom on the reel spool after the unwinding process to a pulper or a broke conveyor BC, for example. In the FIG. 8 unwinding of the reel bottom is performed adjacent to the unwinding station S1 emptying the web W to a pulper of the unwinding station. FIG. 8 in combination with the FIG. 5 discloses that unwinding of the reel bottom can be done to any one of the pulpers of the reel-up—unwinding arrangement 100 or to broke conveyor at desired locations between the unwinding station S1 and the reel-up station S2. Unwinding of the reel bottom can be performed also to any other location, for example on a floor of the machine hall. It is also possible to move full parent It is the most advantageous that the reel bottom is emptied to the pulper of the unwinding station S1 in a manner as explained in the following:

1. The cart is driven at a location above the reel spool containing the bottom of the roll at the unwinding station
2. Hooks of the hoisting devices lowered and the hooks and/or the cart is controlled such that the hooks engage to the reel spool from a neck of its shaft beside body of the reel spool,
3. The reel spool is lifted by hoisting device from the unwinding station,
4. A full parent roll is brought to the unwinding station and operation of the slitter-winder is started
5. When the slitter-winder is stopped after the first or the second set change, an end of the web from the reel bottom is guided to the pulper of the winder-slitter, advantageously along a surface of a pulper hatch
6. The reel spool is rotated by operating the rotator of the assembly to rotate the reel spool thus unwinding the reel bottom from the reel spool to a pulper or a broke conveyor
7. The preparing the next set of the winder-slitter can be started Rotation of the reel spool while supported by the cart is made possible by supporting the reel spool by its bearing houses, which may be accomplished by:

Lifting the reel spool with the hooks 210 from the bearing housings against a stop in the cart The reel spool is lowered to a mechanical the lay-down support to be supported by the bearing housings The reel spool is lowered to a movable mechanical the lay-down support to be supported by the bearing housings In the FIG. 5, the unwinding station S1 is a part of a slitter-winder 110. Thus, the reel-up—unwinding arrangement for a fiber web machine may also be a reel-up—slitter-winder for a fiber web machine, as a particular practical application of the reel-up—unwinding arrangement.

Figure 6:
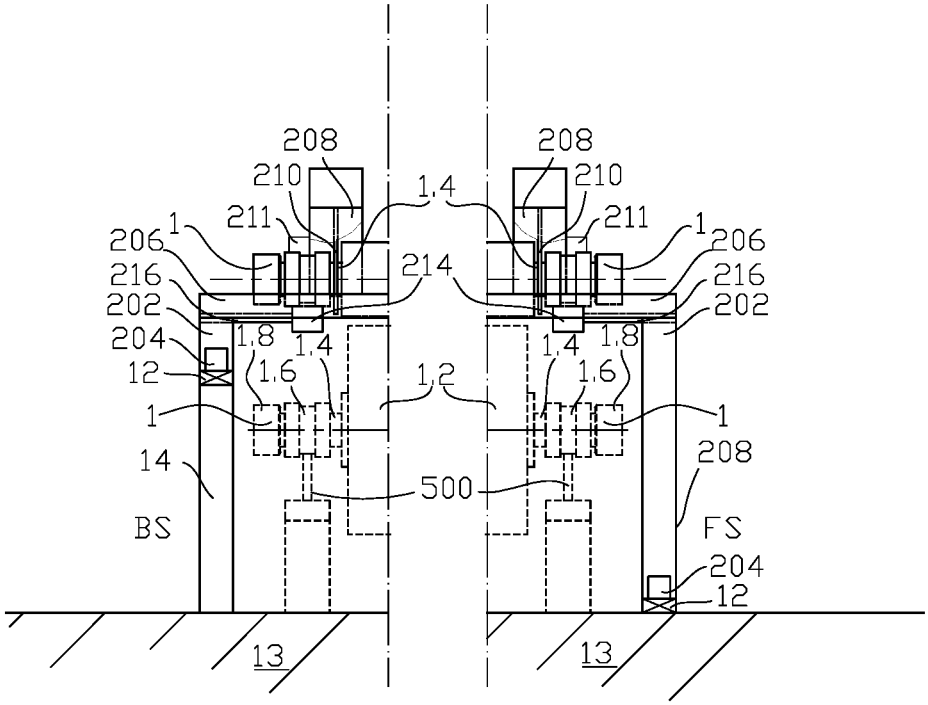
FIG. 6 illustrates an assembly for handling reel spools according to another embodiment of the invention.

FIG. 6 shows an embodiment which is otherwise identical to the FIGS. 1 to 4 but here the support rails 12 of the assembly 10 are at different vertical level. This way, for example the front side rail 12 of the assembly is lower than the back side rail. Here the front side refers to the tending side of the machine and the back side refers to the drive side of the machine. The front side rail 12 is advantageously at the floor level to ease the access to the reel-up—unwinding arrangement 100, since no columns 14 are needed at the front side FS of the reel-up—unwinding arrangement.

Figure 7:
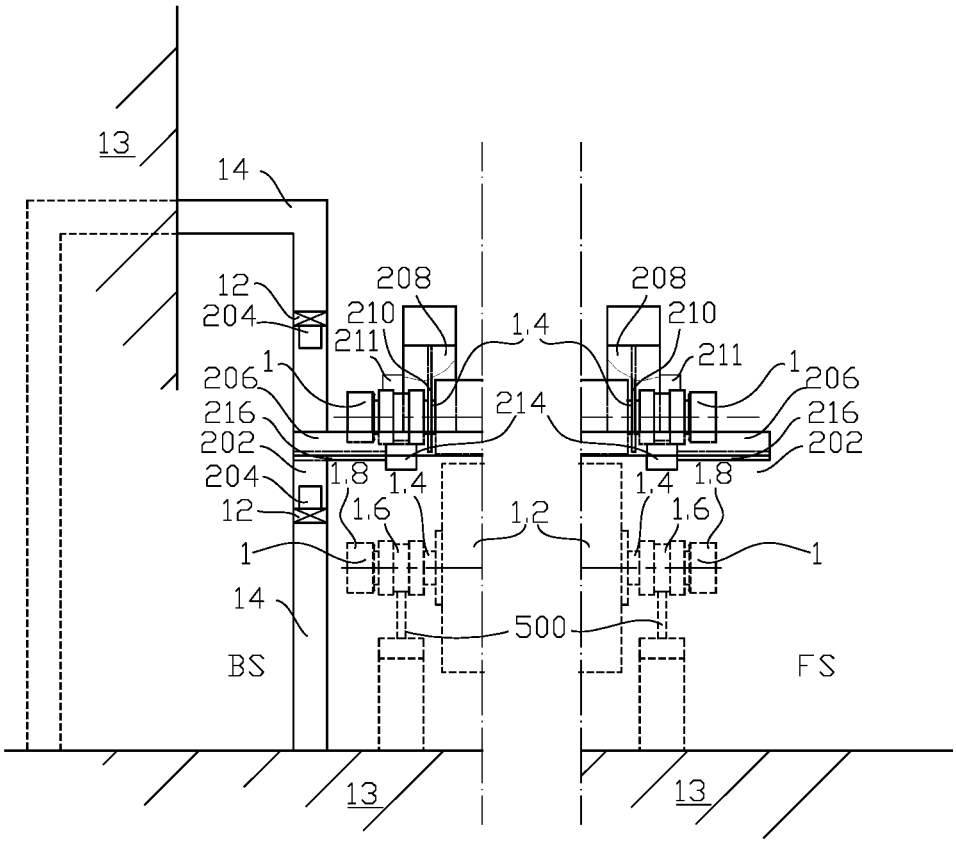
FIG. 7 illustrates an assembly for handling reel spools according to still another embodiment of the invention and FIG. 8 illustrates a reel-up—unwinding arrangement for fiber web according to an embodiment of the invention.

FIG. 7 shows an embodiment which is otherwise identical to the FIGS. 1 to 4 but here the support rails 12 of the assembly 10 are at the same side of the assembly 10 and the cart 20 extend from the back side BS of the assembly to the front side FS of the assembly over the reel-up—unwinding arrangement The front side rail 12 is free from any columns 12 and support rail 12 of the assembly which ease the access to the reel-up—unwinding arrangement 100. The support rails 12 and columns 14 at the back side BS of the assembly are dimensioned to withhold the stress and moment forces caused by the assembly 10. Here the rails 12 are one above the other and the upper column 14 is supported to a suitable foundation 13 at back side of the reel-up—unwinding arrangement, either at the floor level or at higher lever, such at to a rigid wall of the building.

While the invention has been described herein by way of examples in connection with what are, at present, considered to be the most preferred embodiments, it is to be understood that the invention is not limited to the disclosed embodiments, but is intended to cover various combinations or modifications of its features, and several other applications included within the scope of the invention, as defined in the appended claims. The details mentioned in connection with any embodiment above may be used in connection with another embodiment when such combination is technically feasible.

The invention claimed is:

1. An assembly for handling reel spools, comprising linear support rails, having a first end and a second end, arranged parallel to each other, a reel spool cart comprising a transverse bridge, arranged on the support rails, the support rails being arranged at a first distance from each other, the first distance being greater than axial length of the reel spool, the cart being provided with a hoisting device, wherein the hoisting device is configured to hoist the highest point of the reel spool vertically from beneath of at least one of the support rails to at least partly above the at least one of the support rails and in that the reel spool cart is provided with lay-down support for the reel spool at both of the reel spool ends wherein the lay-down support is provided with a drive by means of which the lay-down support is configured to be moved under a bearing housing of the reel spool, after the reel spool has been lifted to a vertical position above the lay-down support.

2. An assembly for handling reel spools according to claim 1, wherein the hoisting device is configured to hoist the highest point of the reel spool vertically from beneath of at least one of the support rails to at least above the lowest point of the transverse bridge.

3. An assembly for handling reel spools according to claim 1, wherein the cart is provided with locking means configured to prevent movement of the hoisted reel spool in relation to the cart at least in the longitudinal direction of the support rails.

4. An assembly for handling reel spools according to claim 3, wherein the locking means comprise a mechanical stop against which at least one of the reel spool and a hook of the hoisting device is moved for locking the reel spool.

5. An assembly for handling reel spools according to claim 1, wherein the hoisting device is configured to lay the reel spool down on the lay-down support.

6. An assembly for handling reel spools according to claim 5, wherein the lay-down support is configured to support the reel spool from the reel support bearing housing at its both ends.

7. An assembly for handling reel spools according to claim 5, wherein the lay-down support is arranged movably in the longitudinal direction of the cart so as to position the lay-down support at a first position under the bearing housings of the reel spool and at a second position outside the length of the reel spool.

8. An assembly for handling reel spools according to according to claim 1, wherein the cart is provided with a reel spool rotator.

9. An assembly for handling reel spools according to claim 8, wherein the rotator is configured transmit force to a clutch part at an end of the reel spool.

10. An assembly for handling reel spools according to according to claim 1, wherein the cart comprises two bridges extending between the support rails and the hoisting device is configured to hoist the reel spool between the bridges.

11. A reel-up—unwinding arrangement for a fiber web machine, comprising a reel-up station at a first end of the arrangement, configured to produce parent rolls from a running web on a reel spool supported from bearing housing at reel spool ends, and an unwinding station at a second end of the arrangement, configured to controllably unwind web from the parent rolls produced in the reel-up station, and an assembly for handling reel spools configured to operate between the reel-up station and the unwinding station, the assembly comprising linear support rails, having a first end and a second end, arranged parallel to each other, a reel spool cart comprising a transverse bridge, arranged on the support rails, the support rails being arranged at a first distance from each other, the first distance being greater than axial length of the reel spool, the cart being provided with a hoisting device, wherein the hoisting device is configured to hoist the highest point of the reel spool vertically from beneath of at least one of the support rails to at least partly above the at least one of the support rails and in that the reel spool cart is provided with lay-down support for the reel spool at its both ends wherein the lay-down support is provided with a drive by means of which the lay-down support is configured to be moved under a bearing housing of the reel spool, after the reel spool has been lifted to a vertical position above the lay-down support.

12. A reel-up—unwinding arrangement according to claim 11, wherein the assembly for handling reel spools is configured to return empty reel spools from the unwinding station to the reel-up station.

13. A reel-up—unwinding arrangement according to claim 11, wherein the arrangement comprises parallel transfer rails between the reel-up station and the un-wind station for transporting the parent rolls from the reel-up station to the unwind station, the transfer rails are arranged at a second distance from each other, the second distance being less than the first distance between the support rails of the assembly for handing the reel spools.

14. A reel-up—unwinding arrangement according to claim 11, wherein the sup-port rails are arranged vertically higher than the transfer rails, and wherein the vertical distance between the support planes of the transfer rail and the support rail is configured such that a gap of less than 200 mm is formed between a full reel spool supported by the transfer rails and an empty reel spool supported by the cart on the support rails.

15. A reel-up—unwinding arrangement according to claim 14, wherein the vertical distance between the support planes of the transfer rail and the support rail is configured such that a gap of 20-200 mm is formed between a full reel spool sup-ported by the transfer rails and an empty reel spool supported by the cart on the support rails.

* * * * *